US005655355A

United States Patent [19]

Ramler

[11] Patent Number: 5,655,355

[45] Date of Patent: Aug. 12, 1997

[54] PACKAGING SYSTEM FOR STACKING ARTICLES IN CARTONS

[75] Inventor: David J. Ramler, Maple Grove, Minn.

[73] Assignee: Dimension Industries, Inc., Maple Grove, Minn.

[21] Appl. No.: 512,156

[22] Filed: Aug. 7, 1995

[51] Int. Cl.[6] ..... B65B 5/10; B65B 35/18

[52] U.S. Cl. ..... 53/475; 53/244; 53/251

[58] Field of Search ..... 53/251, 244, 237, 53/245, 240, 535, 475, 473

[56] References Cited

U.S. PATENT DOCUMENTS

| | | | |
|---|---|---|---|
| 2,247,787 | 7/1941 | Schmidt | 294/64.1 X |
| 2,907,159 | 10/1959 | Allen | 53/251 X |
| 3,168,204 | 2/1965 | Voullaire et al. | 414/793 X |
| 3,198,348 | 8/1965 | Cummings | 214/1 |
| 3,225,891 | 12/1965 | Hickin et al. | 53/251 X |
| 3,637,249 | 1/1972 | Kuhl et al. | 294/64 |
| 3,836,017 | 9/1974 | Bargstedt | 414/793 |
| 3,878,665 | 4/1975 | Couten | 53/251 X |
| 3,948,018 | 4/1976 | Rowekamp | 53/251 X |
| 4,677,808 | 7/1987 | Chenevard | 53/251 X |
| 4,720,227 | 1/1988 | Eberle | 414/32 |
| 4,744,595 | 5/1988 | Tonning et al. | 414/737 X |
| 4,776,148 | 10/1988 | Mingozzi | 53/251 X |
| 4,800,703 | 1/1989 | Goodman | 53/244 X |
| 4,917,427 | 4/1990 | Scaglia | 294/64.1 |
| 5,344,202 | 9/1994 | Ramler et al. | 294/64.1 |

*Primary Examiner*—James F. Coan
*Attorney, Agent, or Firm*—Jacobson & Johnson

[57] ABSTRACT

A cartoner system for picking and placing multiple articles into a single container with the system including one embodiment with a first arm with a pick-up head movable from a first pick-up position to a second carton drop-off position, and a second arm with a pick-up head movable from the same article pick-up position to a second carton drop-off position, with the second arm movable in conjunction with said first arm, so that when pick-up head on the second arm is in the first position picking up a second article, the pick-up head on the first arm is dropping the first article into a container. The cartoner system includes a mechanical drive which maintains conveyors and pickup heads in a synchronous relationship whether the system is speeded up or slowed down.

15 Claims, 7 Drawing Sheets

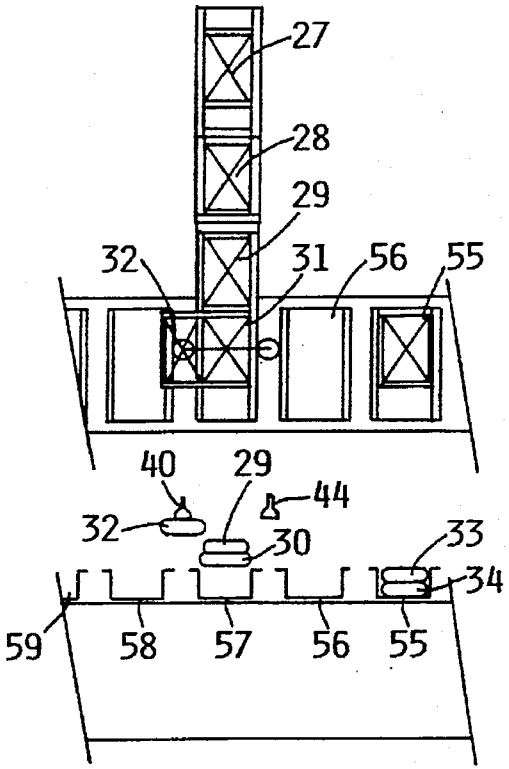
FIG. 7
FIG. 7A
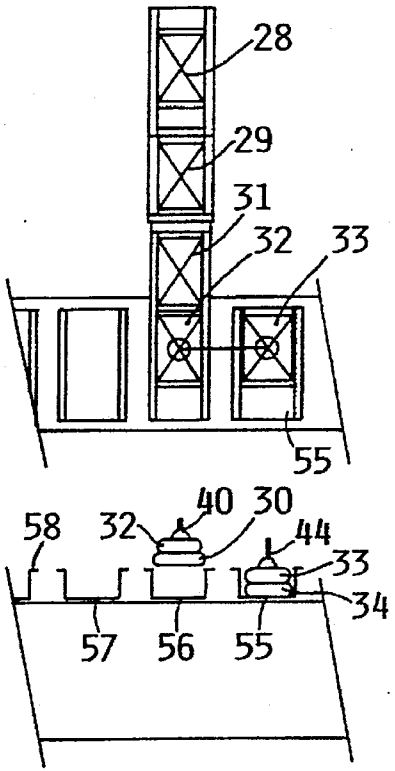
FIG. 6
FIG. 6A
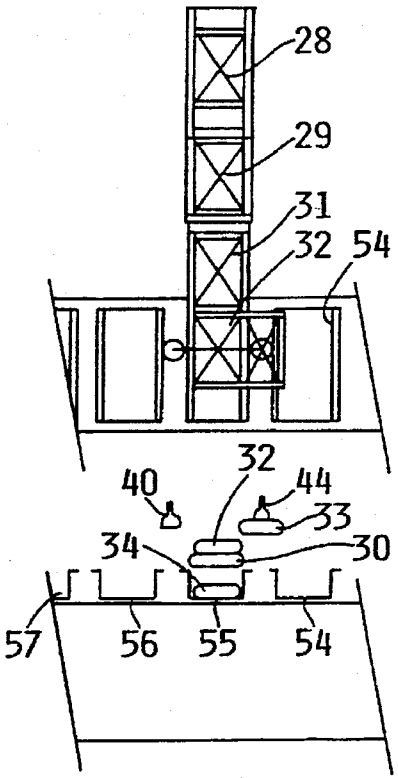
FIG. 5
FIG. 5A

PACKAGING SYSTEM FOR STACKING ARTICLES IN CARTONS

FIELD OF THE INVENTION

This invention relates to an automated cartoner system and, more particularly, to an automated continuous-motion, synchronous, mechanical, cartoner system which can pickup articles from a first conveyor and stack single or multiple articles in a cartoner carried by a second conveyor.

BACKGROUND OF THE INVENTION

Devices with pick-up heads for picking up articles and then placing the articles in cartons are old in the art. Typically, such devices have a suction-type device on one end which holds onto the article while an arm then moves the article to a container where the article is released.

The present invention provides a mechanical drive continuous motion cartoner system with a pick-up device for picking and placing one or more articles into a container. In one embodiment two pick-up heads work in tandem to alternately lift articles from a first conveyor moving in a first direction and then stack the articles in a second container which is moving transverse to the direction of the first conveyor.

BRIEF DESCRIPTION OF THE PRIOR ART

U.S. Pat. No. 4,917,247 shows an air suction lifter for lifting goods in non-rigid packaging such as sacks or the like.

U.S. Pat. No. 3,637,249 shows an automatic loader head for lifting eggs, with the loader head having flexible egg-engaging cups.

U.S. Pat. No. 4,720,227 shows an apparatus for stacking battery plates in which a swing cylinder slides multiple lifting heads between a pick-up position and a drop-off position.

U.S. Pat. No. 3,198,348 shows a loader and unloader which rotates from one position to another to transport articles from one location to another.

U.S. Pat. No. 2,247,787 shows a suction lifter for lifting large, spherical objects such as bowling balls.

U.S. Pat. No. 3,836,017 shows an apparatus for transferring articles between a conveyor and a stack through a pivotal arm.

U.S. Pat. No. 4,744,595 shows a hoisting apparatus for lifting and transporting articles such as paper rolls.

U.S. Pat. No. 3,168,204 shows an apparatus for packing fruits in which a device is rotated 180 degrees between a first pick-up station and a fruit case located at a second station.

U.S. Pat. No. 5,344,202 shows an end effector with individually positionable vacuum cups for moving bulk packages or articles from one location to another.

SUMMARY OF THE INVENTION

Briefly, the invention comprises a mechanical cartoner system including a machine for placing single or multiple articles into a single container, with one embodiment of the system including a first arm with a pick-up head movable from a first pick-up position to a second carton drop-off position, and a second arm with a pick-up head alternately movable from the same first pick-up position to a third carton drop-off position with the second arm movable in conjunction with the first arm so that, when the pick-up head on the first arm is in position to pick-up an article, the pick-up head on the second arm is dropping an article into a carton on a conveyor and when the pick-up head on the second arm is in the first pick-up position to pick-up another article, the pick-up head on the first arm is dropping an article into a carton on a conveyor.

BRIEF DESCRIPTION OF THE DRAWINGS

FIG. 5 is a partial schematic of a top view of the machine of FIG. 1 showing the second bulk package being transferred to a carton.

FIG. 5A is a partial schematic of a front view of the machine of FIG. 1 showing the second bulk package being transferred to a carton.

FIG. 6 is a partial schematic of a top view of the machine of FIG. 1 showing the second bulk package being placed on top of a bulk package in a carton.

FIG. 6A is a partial schematic of a front view of the machine of FIG. 1 showing the second bulk package being placed on too of a bulk package in a carton.

FIG. 7 is a partial schematic of a top view of the machine of FIG. 1 showing transferring a further bulk package to a carton.

FIG. 7A is a partial schematic of a front view of the machine of FIG. 1 showing transferring a further bulk package to a carton.

DESCRIPTION OF THE PREFERRED EMBODIMENT

Figure 1:
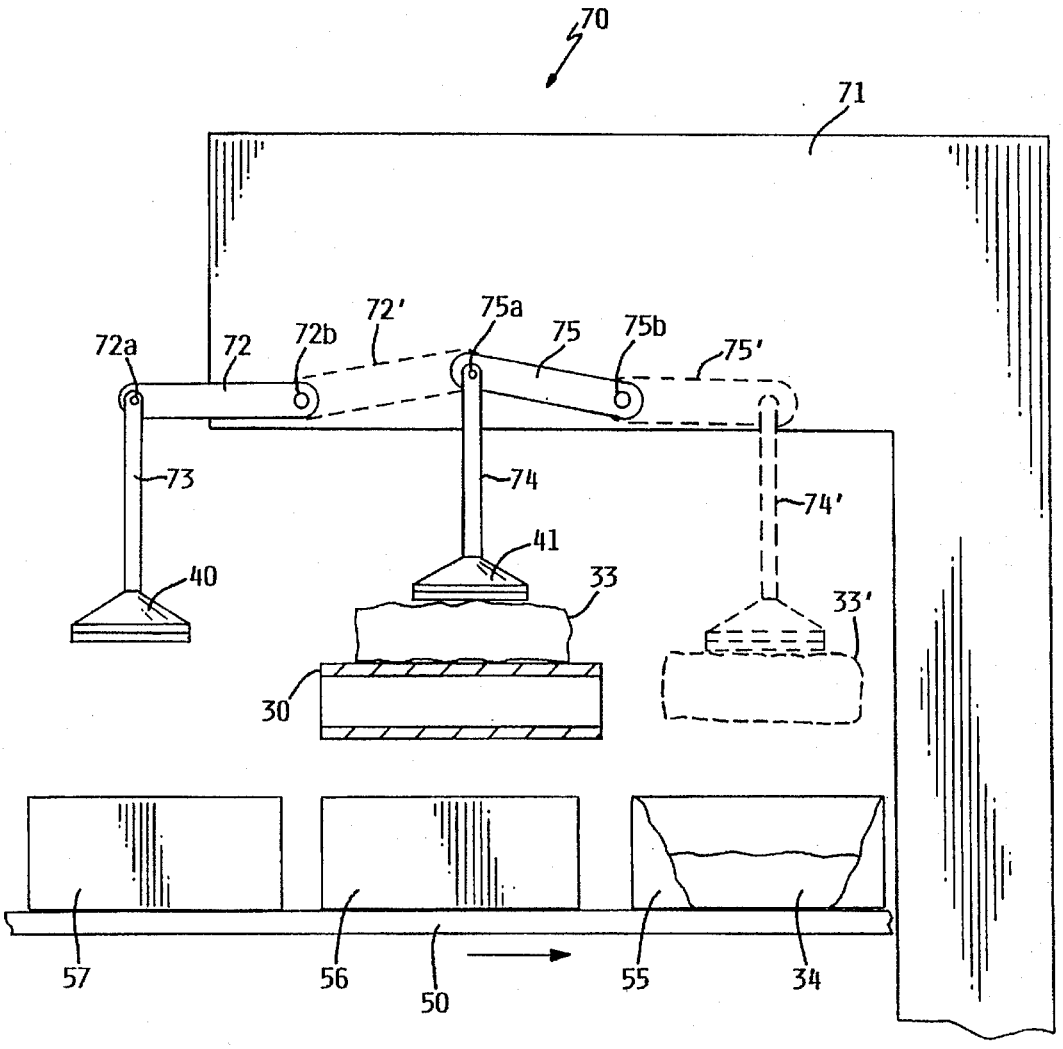
FIG. 1 shows a partial schematic illustrating the machine for placing two or more articles into a single container.

FIG. 1 reference numeral 70 generally identifies a mechanical packaging system which has pickup arms that alternate between picking articles from a first conveyor 30 and stacking the articles in a carton on a second conveyor 50 which is moving in a direction transverse to conveyor 30.

System 70 includes a packaging machine 71 having two synchronized pick-up arms 72 and 75. Packaging machine 71 includes a first arm 75 with a first pick-up head comprised of member 74 and a suction cup 41. Member 74 pivotally connects to arm 75 through a pivot pin 75*a* so that member 74 hangs vertically downward when an article is held thereon by suction cup 41. A drive shaft 75*b* rotates arm 75 between a first article pick-up position, which is indicated by the solid line, and an article drop-off position, which is indicated by dotted lines 75' and 74'. Although both of the arms are synchronized to move in unison, it is possible under certain conditions one may not want the arms to move in synchronized action but only to avoid entanglement with each other when articles are picked up from conveyor 30.

Similarly, packaging machine 71 includes a second arm 72 with a second pick-up head comprised of a member 73 and a suction cup 40. Member 73 pivotally connects to arm 72 through a pivot pin 72*a*, so that member 73 hangs vertically downward when an article is held thereon by suction cup 40. A drive shaft 72*b* rotates arm 72 between a first article drop-off position (indicated by solid lines 73 and 40) and an article pick-up position which is identical to the article pick-up position of arm 75. In the preferred embodiment, a drive member (not shown) positively controls members 73 and 74 so that members 73 and 74 remain in a vertical orientation and do not swing to and fro during the cycling of arms 72 and 75. Holding arms 74 and 75 in a vertical position minimizes the chances of an article accidentally being knocked off during the article transfer from conveyor to carton.

Reference numeral 30 identifies a first conveyor moving toward the observer with an article, such as a bulk package 33, located thereon. Conveyor 30 moves intermittently to move an article into the article pickup position by one of the pick-up heads. After the article is picked up, the conveyor again advances to move another article into the article pick-up position by the other pick-up head as the pickup arms are delivering the articles to the placement position. In this manner arms 73 and 74 alternate because both move to an article pick-up position but at opposite points of their cycles.

Located below conveyor 30 and moving in a direction transverse to the direction of conveyor 30 is a second conveyor 50 carrying a plurality of cartons 55, 56 and 57 for receiving bulk packages for shipping. In the embodiment shown, conveyor 50 continually moves while articles are being stacked in the cartons located thereon by the pickup arms.

The pick-up heads 40 and 41 are of the conventional type. The mechanisms for pickup and release of bulk products are more fully described in my U.S. Pat. No. 5,344,202 which is incorporated herein by reference.

Preferable operation of packaging machine 71 has arms 72 and 75 moving in synchronized motion between a first pick-up position on top of conveyor 30 to two different package drop-off positions. Arm 72 is movable from the article pick-up position above conveyor 30 to a first article drop-off position on the left side of conveyor 30, and the second arm 75 is movable from the article pick-up position above conveyor 30 to a second article drop-off position located to the fight of conveyor 30.

To appreciate the action of the system in picking and placing articles, refer to FIGS. 2 to 7 in conjunction with FIGS. 2A through 7A which illustrate the picking and stacking of articles onto a carton on a moving conveyor.

Figure 2:
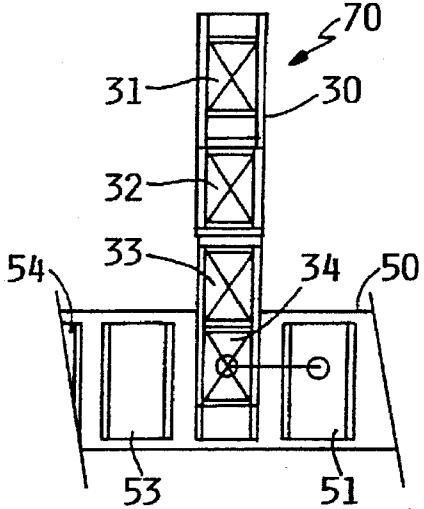
FIG. 2 is a partial schematic of the top view of the machine of FIG. 1 showing a first bulk package being picked up for transfer to a carton.
Figure 2A:
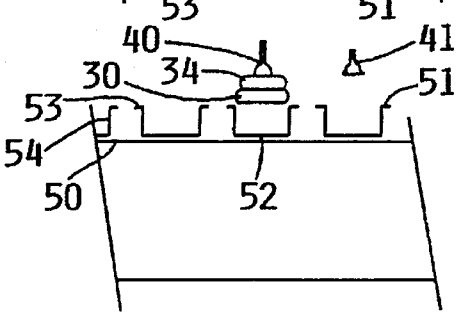
FIG. 2A is a partial schematic of a front view of the machine of FIG. 1 showing a first bulk package being picked up for transfer to a carton.

FIG. 2 shows a top view of system 70 and FIG. 2A shows a front view of system 70 with a first conveyor 30 carrying bulk packages 31, 32, 33, and 34 thereon. Located below conveyor 30 is a second conveyor 50 which is traveling from left to right. Conveyor 30 is carrying a plurality of cartons 51, 52, 53 and 54. FIGS. 2 and 2A show pick-up head 40 in the article pick-up position engaging package 34 on conveyor 30. Pick-up head 41 is shown empty.

Figure 3:
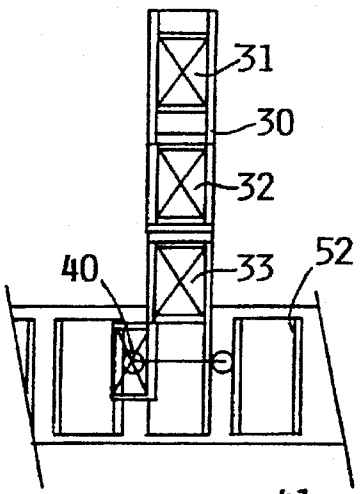
FIG. 3 is a partial schematic of a top view of the machine of FIG. 1 showing a first bulk package being transferred to a carton.
Figure 3A:
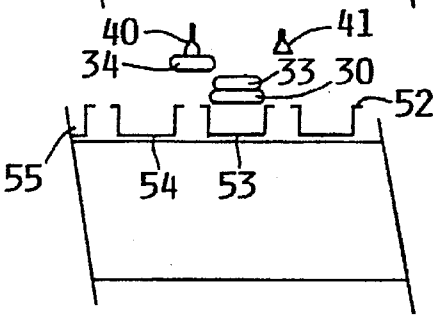
FIG. 3A is a partial schematic of a front view of the machine of FIG. 1 showing a first bulk package being transferred to a carton.

FIGS. 3 and 3A show that article 34 has been picked up from conveyor 30 and is being moved to the left of conveyor 30 while conveyor 30 has advanced a second article 33 into the article pick-up position. Pick-up head 41, which is moving in conjunction with pick-up head 40, is moving toward the first article pick-up position above conveyor 30 to pick up article 33 on conveyor 30.

Figure 4:
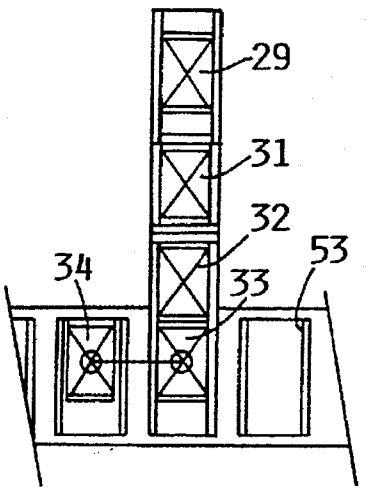
FIG. 4 is a partial schematic of a top view of the machine of FIG. 1 showing a first bulk package being placed in a carton and a second bulk package being picked up from the conveyor.
Figure 4A:
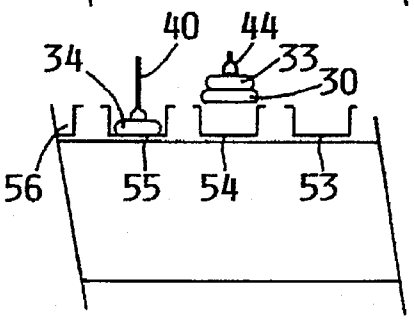
FIG. 4A is a partial schematic of a front view of the machine of FIG. 1 showing a first bulk package being placed in a carton and a second bulk package being picked up from the conveyor.

FIGS. 4 and 4A show that article 34 has been placed in carton 55 and that pick-up head 44 is picking up a second article 33. Note the movement of conveyor 50 to the left with the presence of cartons 55 and 56 which were not visible when article 34 was being picked up from conveyor 30.

FIGS. 5 and 5A show that article 34 which had been placed in carton 55 is moving to the fight on conveyor 50 and that pick-up head 44 is moving a second article 33 to the fight of conveyor 30.

FIGS. 6 and 6A show that article 33 has been placed on top of article 34 in carton 55 and that pick-up head 40 is picking up a third article 32 for placement in a further carton on the conveyor 50.

FIGS. 7 and 7A show the repeat of the cycle with pick-up head 40 moving an article 32 to a carton, while articles 33 and 34 have been placed in carton 55 and pick-up head 44 moving toward a further article 29 located in the article pick-up position for placement in another carton to permit the continued packaging of stacked articles in the cartons.

The present invention is shown with every, fourth carton being filled with bulk packages. Various modification to the system permit filling every carton with two or more articles. For example, if four conveyors and four packaging machines 71 are feeding articles for packaging, one could fill each of the cartons with two or more packages. Likewise, slowing down conveyor 50 could permit filling every carton even if there were only one packaging machine 71. Thus, the present invention allows taking bulk packages from a single conveyor and stacking the articles in a carton through the dual action of the two arms which operate in unison but function oppositely. That is, when one arm is picking up an article, the other arm is dropping off mother article. The use of two spaced drop-off stations provides an on-the-go low cost mechanical packaging system which drops the articles into a continually moving carton and still pack multiple bags into the same carton or container. A mechanical drive controls the movement of the arms which typically swing about 180 degrees from side to side with the pivot support for the arms spaced sufficiently far apart, so that the pick-up heads on each arm are in the same article pick-up position during the pick-up phase of operation.

Figure 8:
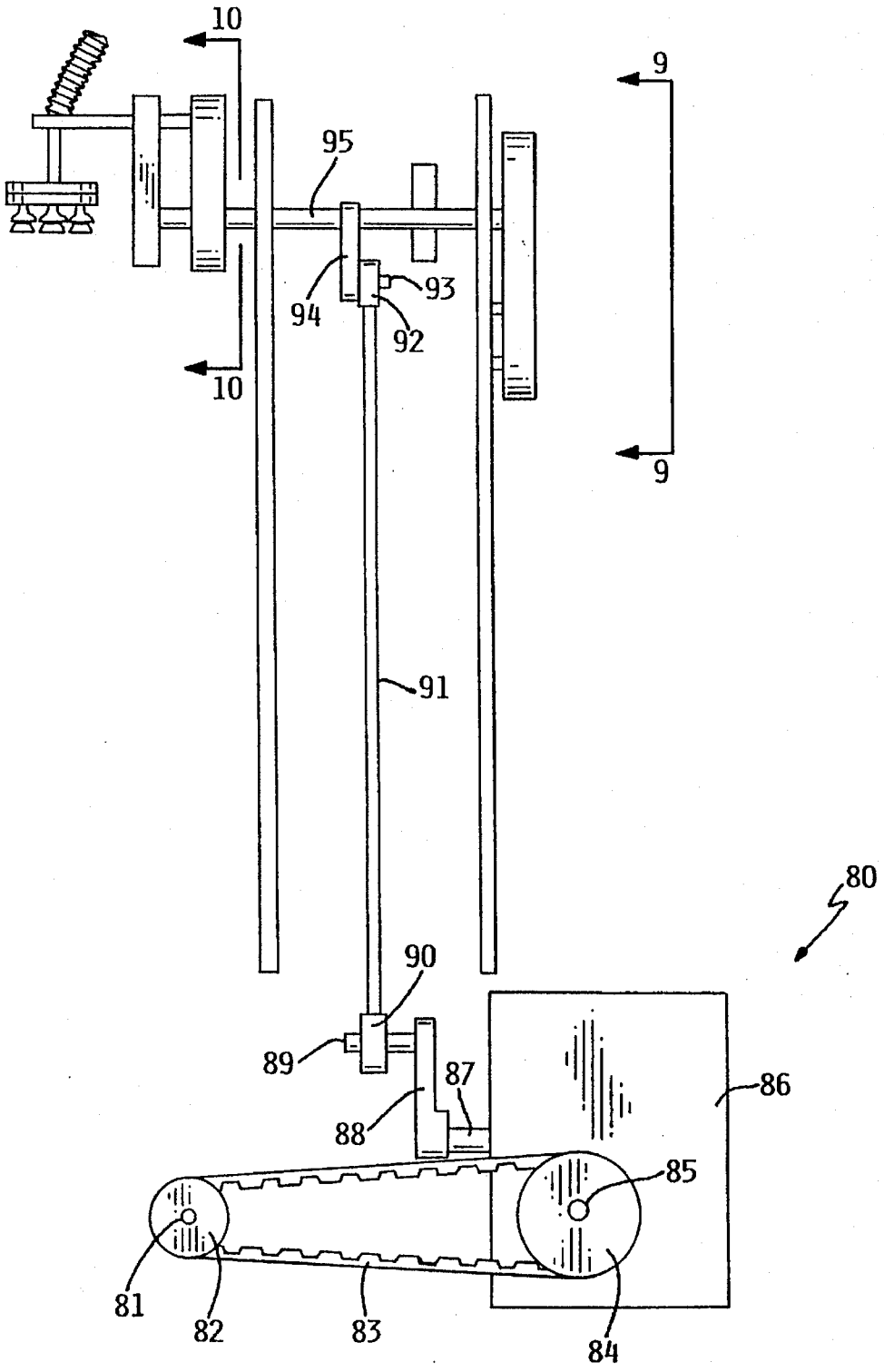
FIG. 8 shows a partial side view of the mechanical drive system of the cartoner system.

Referring to FIG. 8 there is shown a partial side view of the drive system 80 for translating the rotational motion of a single drive shaft into the pick and place motion for picking articles from one conveyor and placing them in compartments for packaging. System 80 includes a powered drive shaft 81 which powers the conveyors and the pickup arms. Connected to drive shaft 81 is a pulley 82. A belt 83 connects pulley 82 to pulley 84 on a gear reducer 86. A shaft 85 extends into gear reducer and through internal gears to rotate shaft 87 and crank arm 88. The purpose of gear reducer 80 is to provide a different power output that can be used to control the mechanical pickup arms. By having a single drive shaft controlling both the conveyors and the pickup arms one is assured that the pickup arms and conveyors can be kept in synchronous relationship during the picking and placing cycle.

Connected to the end of crank arm 88 is a an extension 89 that rotateingly engages a bushing 90 located on one end of tie rod 91. Similarly, on the other end of tie rod 91 is a bushing 92 that rotatingly engages rod 93 on a second crank arm 94. The use of crank arm 88 produces produces a generally lengthwise oscillation of tie rod 91. By connecting the opposite end of the tie rod 91 to crank arm 94 one converts the oscillating motion of tie rod 91 to a partial rotation of a shaft 95.

Figure 9:
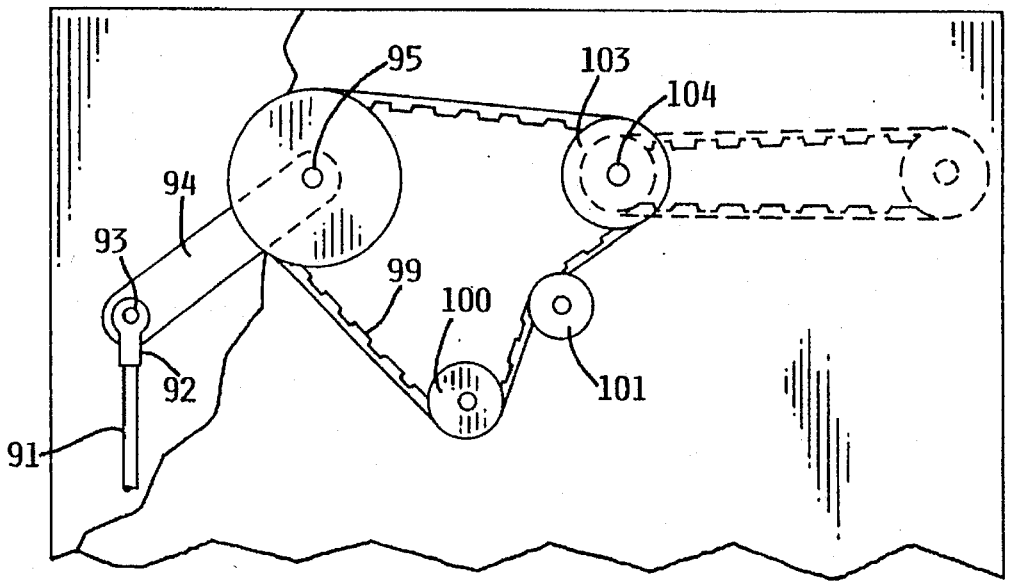
FIG. 9 shows a partial cut away view taken along lines 9—9 of FIG. 8 which shows the crank drive in a first position.
Figure 9A:
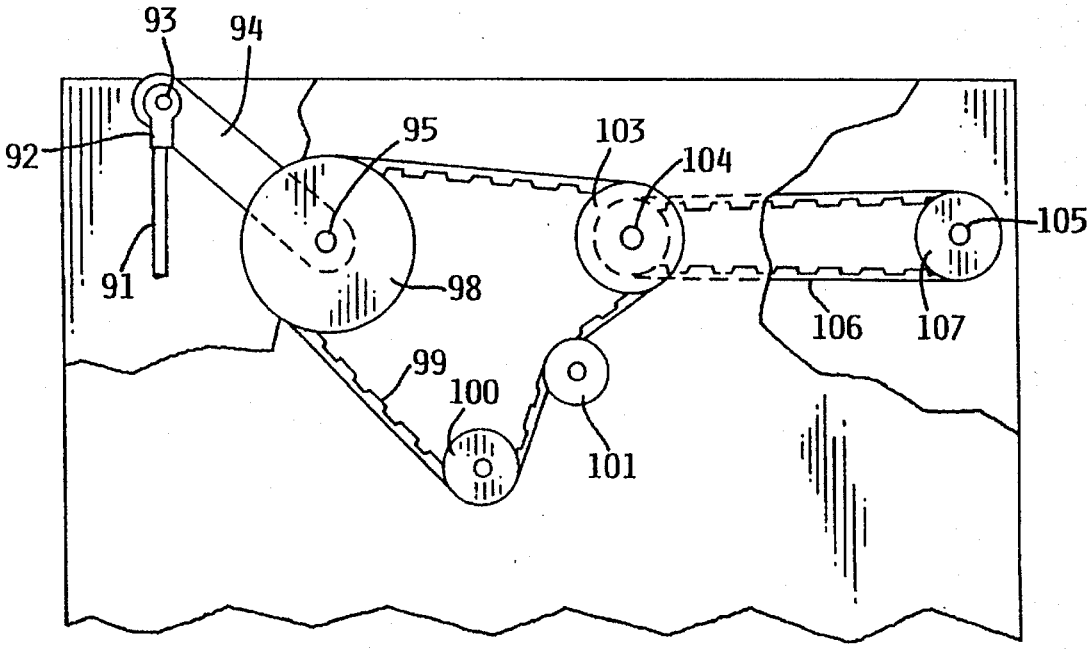
FIG. 9A shows a partial cut away view taken along lines 9—9 of FIG. 8 which shows the crank drive in a second position and a further cut-away view to show the drive pulley for the pickup heads.

Reference should be made to FIG. 9 and FIG. 9A which shows a partial cutaway view with arm 94 located in the bottom portion of its motion in FIG. 9 and in the top portion of its stroke in FIG. 9A. Thus tie rod 91 produces a partial rotation of shaft 95 with the amount of partial rotation of shaft 95 determined by selecting the appropriate length for the crank arms 88 and 94. At this point in the system the rotary, motion of the drive shaft 81 has been changed and converted into a partial rotation which can be used to drive the pickup arms and pickup heads from a pickup position to a placement position.

FIG. 9A shows arm 94 connected to shaft 95 which is connected to pulley 98. A drive belt 99 connect pulley 98 to pulley 103 with a first idler 100 and a second idler 101 located in engagement with belt 99. In operation of the system pulley 103 drives shaft 104 which is connected to on of the pick up arms. A second shaft 105 connects to a second pick up arm. In order to keep the pick up arm in unison a drive belt 106 connects pulley 107 to a further pulley connected to shaft 104. In the embodiment shown the shaft 104 and 105 are driven simultaneously through an arc in excess of 90 degrees.

In order to keep the units in synchronous motion it is preferred to use flexible timing belts having crosswise teeth that mechanically engage a corresponding set of crosswise teeth on timing pulleys to thereby provide positive non-slipping rotation between the pulleys and the belts.

Figure 10:
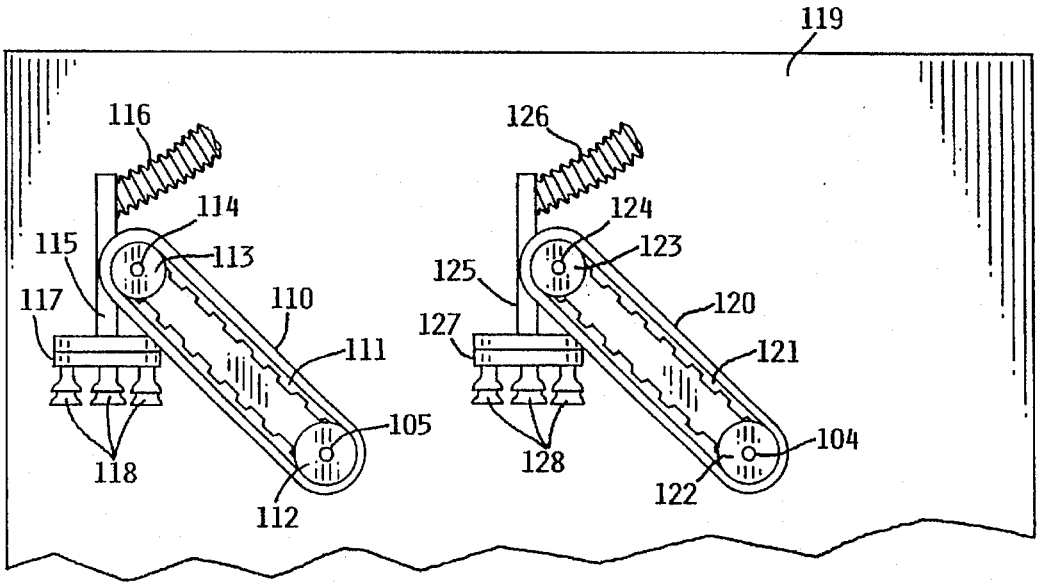
FIG. 10 shows a partial side view of the pickup arms in a first position.

FIG. 10 shows the pick up arms 110 and 120 in a first position to pick up an article. Pickup arm 110 is driven by shaft 105 which is journaled through pulley 112 which is affixed to housing 119 to prevent rotation of pulley 112. A belt 111 connects to a pulley 113 which connects to shaft 114 that connects to pickup head 115. Pickup head 115 includes a flexible tube 116 for attachment to a vacuum source and a set of bellows type pickups 118 mounted on a rotatable housing 117. Similarly, pickup arm 120 is driven by shaft 104 which is journaled through pulley 122 which is affixed to housing 119 to prevent rotation of pulley 122. A belt 121 connects to a pulley 123 which connects to shaft 124 that connects to pickup head 125. Pickup head 125 includes a flexible tube 126 for attachment to a vacuum source and a set of bellows type pickups 128 mounted on a rotatable housing 127.

Figure 10A:
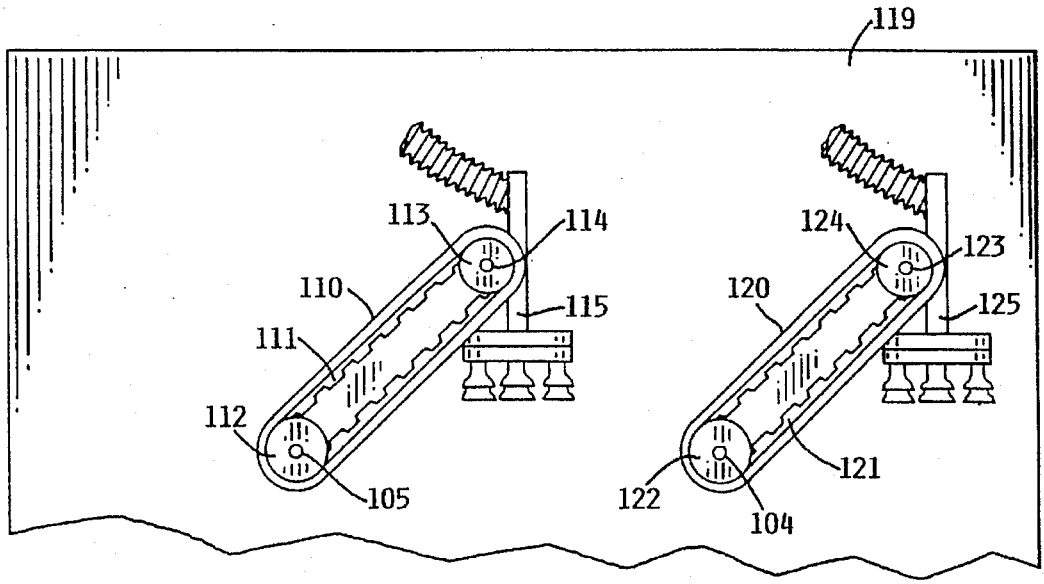
FIG. 10A shows a partial side view of the pickup arms of FIG. 9 in a second position.

FIG. 10A illustrates pickup arms 110 and 120 at the opposite end of the strokes. As pulleys 112 and affixed to housing 119 the belt 111 rotates pulley 113 and corresponding shaft 114 to maintain pickup member 115 in the vertical position. Similarly, as pulleys 122 and affixed to housing 119 the belt 121 rotates pulley 123 and corresponding shaft 124 to maintain pickup member 125 in the vertical position. That is, the diameter of both pulleys are the same so that any rotational motion imparted to the end of the crank arm is compensated by the reversing action of the belt.

Figure 11:
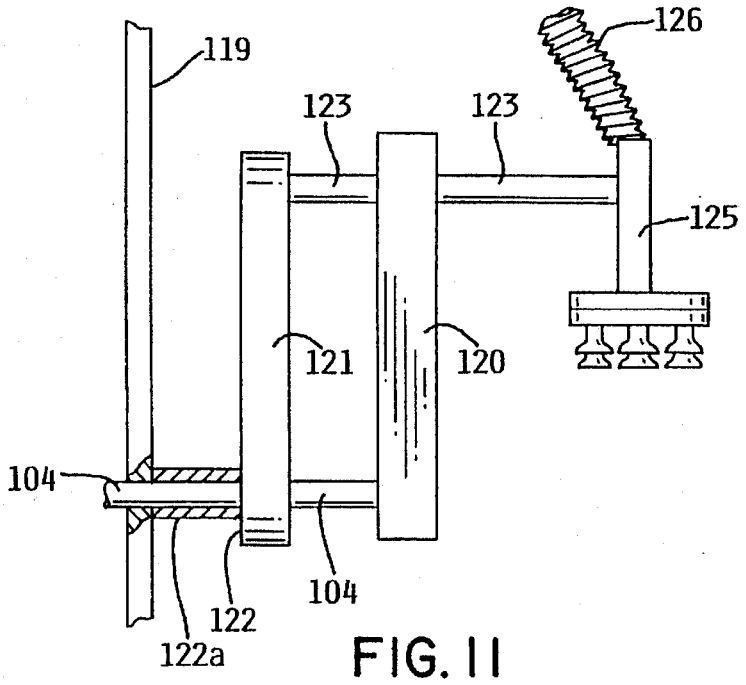
FIG. 11 shows a partial side view of the pickup arms and pickup heads of FIG. 9.

FIG. 11 shows a partial side view of one of the pick up members 120/Shaft 104 extends through housing 119 and engages pickup arm 120 to drive pickup arm 104 back and forth. Pulley 122 is shown affixed to housing 119 by sleeve 122*a* to prevent rotation of the pulley 122. The belt 121 engages and rotates shaft 123 as arm 120 is moved from one position to another thereby assuring that pickup head 125 will remain in the vertical orientation.

As can be viewed from FIGS. 8–11 the entire system is mechanically driven and can be driven and controlled by single power source which can mechanically maintain the system in synchronous relationship. While the system is mechanical driven and operated sensor can be placed in the system to shut down the system if a malfunction should occur.

Figure 12:
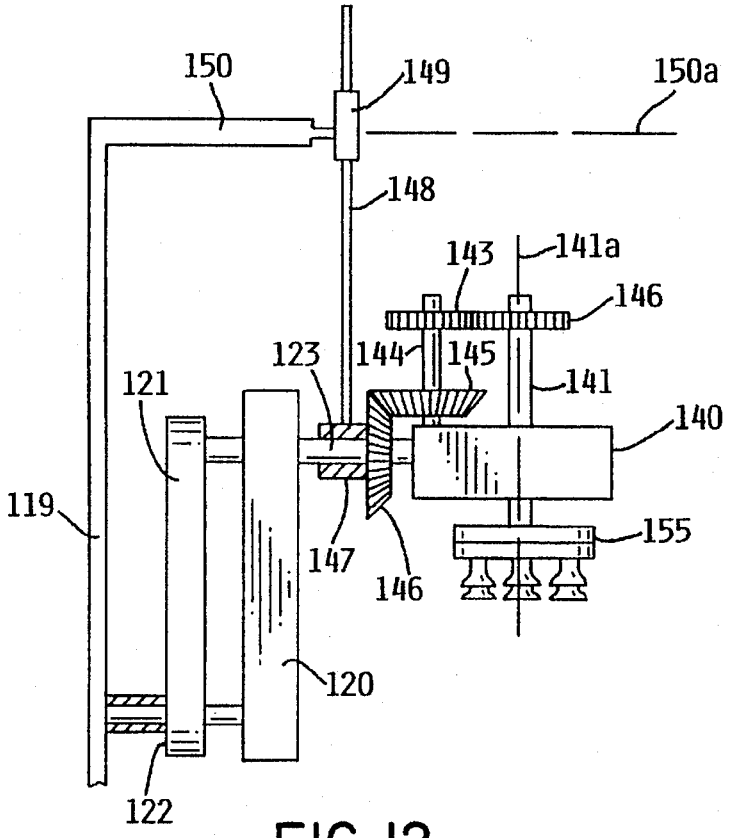
FIG. 12 shows an alternate embodiment of pickup arms with a mechanical rotational means for automatically rotating a pickup between a first position on pickup of an article and a second position on placement of the article.

FIG. 12 shows a further embodiment that includes a mechanical gear linkage to rotate the pickup head as the pickup arm moves from one position to another. That is, is in some applications it can be necessary to reorientate the package before it is placed in a container for packaging. The embodiment of FIG. 12 provides mechanical means for rotating the pickup head and article supported thereon. Note, like parts in FIG. 11 contain identical numbers. The mechanical gear linkage for rotation pickup head 155 comprises a housing 140 that supports a shaft 141 that carries a gear 142 that is in engagement with 45° bevel gear 143 that connects to shaft 144. Bevel gear 143 engages a further bevel gear 146 that is journaled on shaft 123 through a bushing 147 that connects to a rod 148 that slides within a pivotable journaled member 149. That is rod 148 is displaceable longitudinally through member 149 while member 149 is rotatable about axis 150*a* which extends through support 150. In operation of the unit the arm 148 maintain the proper position of bevel gear 146 to insure that the proper amount of rotation of shave 144 is transferred to pickup head 155 in order to rotate the pickup head about axis 141*a*.

Thus the mechanical cartoner system of the present invention allows one to speed up or slow down the system without upsetting the relationship of the conveyors to the the pickup arms as the entire system is mechanically driven off a single drive shaft.

I claim:

1. A cartoner machine for picking and placing multiple articles into a single container comprising:

a first arm, said first arm movable from an article pick-up position to a first article drop-off position, said first arm including a pick-up head for lifting a first article to enable transporting the first article from the article pick-up position to a container;

a conveyor for moving the articles to the first position for pick-up and transfer to the container;

a second arm, said second arm movable from the article pick-up position to a second article drop-off position, said second arm including a pick-up head for lifting a second article to enable transporting the second article from the article pick-up position to the container, said second arm movable in conjunction with said first arm so that when said pick-up head on said first arm is in the article pick-up position, said pick-up head on said second arm is in a position remote from the article pick-up position to avoid interfering with said first arm, said first arm and said second arm located above the container for moving articles, and said first arm and said second arm movable laterally of said conveyor to provide on-the-go filling of the container.

2. The machine of claim 1 wherein said firm arm and said second arm each include a pivotable member to maintain the pick-up head in a horizontal position during transporting an article from one conveyor to another.

3. The machine of claim 1 including a conveyor drive member for intermittently moving articles to the first position.

4. The machine of claim 1 including a container conveyor, said container conveyor carrying a plurality of containers for filling with at least two articles.

5. The machine of claim 1 wherein the pick-up head includes vacuum cups.

6. The machine of claim 1 wherein the conveyor for moving articles is located transverse to said container conveyor carrying a plurality of containers.

7. The machine of claim 1 including a second machine positioned proximate said first machine to place articles in a second container on said container conveyor.

8. A continuous motion mechanical system for picking and placing articles comprising:

a first conveyor for delivering a plurality of articles for pickup;

a second conveyor for receiving a plurality of articles;

a pickup arm for pickup of an article from the first conveyor and for depositing the article on the second conveyor;

a plurality of pickup heads which are rotatable to reorientate articles on-the-go as the articles are transferred from one conveyor to another conveyor;

a drive shaft, said drive shaft powering said first conveyor and said second conveyor, said drive shaft further powering said pickup arm; and a mechanical drive system, said mechanical drive system powered by said drive shaft with said mechanical drive system linked to the drive shaft so that the conveying system and the pickup arms remaining in synchronous relationship to each other even though the rotation of the drive shaft is changed to accommodate a bagging condition.

9. The continuous motion mechanical system of claim 8 including means for transferring rotational motion of the drive shaft into oscillating motion.

10. The continuous motion mechanical system of claim 8 including mechanical means for rotating the pickup heads from one position to another position.

11. The continuous motion mechanical system of claim 8 including timing belts and timing pulleys for maintaining the synchronous relationship between components of the system.

12. A method of filling a container with two or more packages comprising:

moving a first article into an article pick-up position;

picking up the first article from the article pick-up position;

placing the first article in a container;

moving a second article into the article pick-up position while moving the first article to the container;

picking up the second article in the article pick-up position while the first article is being dropped off into the container;

dropping the second article into the container on top of the first article in the container to stack articles on top of each other in the container and;

continually moving the container during the picking and dropping of the articles into the container.

13. The method of claim 12 wherein the picking up of the second article and the dropping off of the first article occur substantially simultaneously.

14. The method of claim 13 wherein the articles are intermittently moved into the article pick-up position for transfer to the containers.

15. The method of claim 14 wherein a vacuum cup is used to pick up and drop articles.

* * * * *